US008447068B2

(12) United States Patent
Matthes et al.

(10) Patent No.: US 8,447,068 B2
(45) Date of Patent: May 21, 2013

(54) METHOD FOR CHARACTERIZING THE EXHAUST GAS BURN-OFF QUALITY IN COMBUSTION SYSTEMS

(75) Inventors: Joerg Matthes, Karlsruhe (DE); Hubert Keller, Karlsruhe (DE); Hans Hunsinger, Weingarten (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 1127 days.

(21) Appl. No.: 12/438,279

(22) PCT Filed: Aug. 22, 2007

(86) PCT No.: PCT/EP2007/007370

§ 371 (c)(1),
(2), (4) Date: Feb. 20, 2009

(87) PCT Pub. No.: WO2008/034508

PCT Pub. Date: Mar. 27, 2008

(65) Prior Publication Data

US 2009/0190799 A1 Jul. 30, 2009

(30) Foreign Application Priority Data

Sep. 20, 2006 (DE) ..... 10 2006 044 114

(51) Int. Cl.

| | |
|---|---|
| ***G06K 9/00*** | (2006.01) |
| ***G06K 9/34*** | (2006.01) |
| ***G06K 9/46*** | (2006.01) |
| ***G06K 9/66*** | (2006.01) |
| ***G06K 9/48*** | (2006.01) |

(52) U.S. Cl.
USPC ..... 382/103; 382/100; 382/173; 382/190; 382/199

(58) Field of Classification Search
USPC ..... 382/100, 103
See application file for complete search history.

(56) References Cited

U.S. PATENT DOCUMENTS 4,622,922 A * 11/1986 Miyagaki et al. ..... 122/449
4,737,844 A * 4/1988 Kohola et al. ..... 348/83
4,907,281 A * 3/1990 Hirvonen et al. ..... 382/100

(Continued)

FOREIGN PATENT DOCUMENTS

DE 19710206 9/1998
DE 19735139 2/1999

(Continued)

OTHER PUBLICATIONS http://www.webleam.hs-bremen.de/risse/AWI/TEXTUR/merkmale.htm "Teil 1: Texturmerkmale, Grauwertübergangsmatrix-Verfahren"; downloaded on Feb. 20, 2009.

*Primary Examiner* — Michelle Entezari
(74) *Attorney, Agent, or Firm* — Leydig, Voit & Mayer, Ltd.

(57) ABSTRACT

A method for characterizing a flue gas burnout quality of a combustion process in a combustion system having a gas burnout zone includes optically detecting in a visible wavelength range, in a flow cross section of the gas burnout zone, low-soot combustion regions, regions without combustion, and sooting regions, so as to provide a plurality of successive individual images, the regions without combustion and the sooting regions having different dynamics. The plurality of successive individual images are analyzed so as to distinguish regions of transition, to the low-soot combustion regions, of the regions without combustion and the sooting regions.

5 Claims, 3 Drawing Sheets

U.S. PATENT DOCUMENTS

| | | | | |
|---|---|---|---|---|
| 4,965,841 | A * | 10/1990 | Kaneko et al. | 382/100 |
| 5,091,963 | A * | 2/1992 | Litt et al. | 382/149 |
| 5,748,775 | A * | 5/1998 | Tsuchikawa et al. | 382/190 |
| 5,890,444 | A | 4/1999 | Martin et al. | |
| 5,993,194 | A * | 11/1999 | Lemelson et al. | 431/14 |
| 6,419,638 | B1 * | 7/2002 | Hay et al. | 600/558 |
| 6,463,163 | B1 * | 10/2002 | Kresch | 382/103 |
| 6,526,154 | B1 * | 2/2003 | Taipale et al. | 382/100 |
| 6,670,963 | B2 * | 12/2003 | Osberger | 345/629 |
| 7,346,212 | B2 * | 3/2008 | Cheatle | 382/173 |
| 7,536,048 | B2 * | 5/2009 | Moravec et al. | 382/164 |
| 7,542,585 | B2 * | 6/2009 | Chen | 382/100 |
| 7,596,250 | B2 * | 9/2009 | Dioguardi et al. | 382/128 |
| 7,881,513 | B2 * | 2/2011 | Bernard et al. | 382/128 |
| 8,138,927 | B2 * | 3/2012 | Diepenbroek et al. | 340/577 |
| 8,144,927 | B2 * | 3/2012 | Zuro | 382/103 |
| 8,290,277 | B2 * | 10/2012 | Hwang et al. | 382/190 |
| 2002/0051579 | A1 * | 5/2002 | Dugue et al. | 382/228 |
| 2005/0074140 | A1 * | 4/2005 | Grasso et al. | 382/103 |

FOREIGN PATENT DOCUMENTS

| | | |
|---|---|---|
| DE | 10347340 | 1/2005 |
| EP | 0897086 | 2/1999 |
| NL | 9400192 | 9/1995 |
| WO | WO-0016010 | 3/2000 |

* cited by examiner

METHOD FOR CHARACTERIZING THE EXHAUST GAS BURN-OFF QUALITY IN COMBUSTION SYSTEMS

CROSS REFERENCE TO PRIOR APPLICATIONS

This application is a U.S. National Phase application under 35 U.S.C. §371 of International Application No. PCT/EP2007/007370, filed on Aug. 22, 2007 and claims benefit to German Patent Application No. DE 10 2006 044 114.1, filed on Sep. 20, 2006. The International Application was published in German on Mar. 27, 2008 as WO 2008/034508 A1 under PCT Article 21(2).

FIELD

The present invention relates to a method for characterizing the flue gas burnout quality in combustion systems having a gas burnout zone.

BACKGROUND

In industrial combustion processes, it is a goal to burn out flue gases efficiently and as completely as possible. Efficient flue gas burnout is characterized by low concentrations of incompletely burned products of combustion, such as CO, hydrocarbons, and particulate carbon (soot particles). The corresponding emission limits are usually defined in the relevant legal provisions. In Germany, for example, the limits on carbon monoxide, CO, and hydrocarbons, $C_nH_n$ are laid down in the $17^{th}$ Ordinance implementing the Federal Immission Control Act (Bundesimmissionsschutzverordnung, BImSchV).

Fuels such as household waste, biomass, or coal, which have varying moisture contents, are very inhomogeneous. Because of their highly heterogeneous composition, such fuels have widely varying heating values. Therefore, today, complex combustion control systems including infrared detectors (IR cameras, infrared cameras) are used in combustion chambers of industrial combustion systems. In grate combustion systems, the position of the flames from the bed of solids is detected by the infrared radiation from the fuel bed using an IR camera. The detected wavelength (e.g., 3.9 μm) is in a range in which combustion gases themselves have no emissivity. This information is used to control the kinematics of the grate and/or the various primary gas flows passing through the bed of solids. This makes it possible to achieve an essentially complete burnout of the solid matter in the slag.

When flue gas from non-uniform combustion exits a combustion chamber (for example, from a solid bed burnout zone), such flue gas usually has locally high concentrations of incompletely burned compounds such as CO, hydrocarbons, and soot. The gas flow exiting the combustion bed is characterized by the formation of streaks with enormous local and temporal variations in the concentration of the aforementioned incompletely burned compounds and of the oxygen concentration. These streaks extend through the flue gas burnout zone in the first radiation pass. Homogeneous mixing of the flue gas, and thus complete burnout thereof, is frequently not possible due to insufficient time and insufficient turbulence. Therefore, to remedy incomplete burnout of the flue gases, an oxygen-containing secondary gas is introduced into the flue gas burnout zone. The total amount of this secondary gas is selected such that a defined excess of oxygen (minimum oxygen concentration) is always maintained downstream of the flue gas burnout zone. The minimum oxygen concentration is limited by the minimum combustion temperatures required downstream of the flue gas burnout zone.

DE 103 47 340 A1 describes a device for optimizing the flue gas burnout in combustion systems having a solid bed burnout zone and a flue gas burnout zone. That device includes several controllable nozzles for introducing oxygen-containing secondary gas into an effective area of the flue gas burnout zone. The determination of the various incompletely burned gas components (CO and hydrocarbons) in the effective area is accomplished by measuring the radiation intensity using an infrared camera or any other spectral measurement device. The data acquired in this manner is converted into control signals for each of the controllable nozzles to enable controlled introduction of secondary gas.

However, the device and associated method are used for non-selective determination of incompletely burned gas components in the flue gas. In the process, both incompletely burned gases and solid components (e.g., soot) are determined in the form of a sum signal, with no weighting between the various components being possible. Furthermore, it may happen that areas where, due to the lack of combustion gases, no combustion activity takes place are also identified as being areas of incompletely burned flue gases (cross-sensitivities between the emissivities of $CO_2$ and $H_2O$) In the latter case, injection of an oxygen-containing secondary gas would not cause the gases to be after-burned, but to be diluted and cooled.

SUMMARY

It is an aspect of the present invention to provide a method for characterizing the flue gas burnout quality in combustion systems in terms of soot burnout as a basis for optimizing the flue gas burnout, especially to achieve substantial or complete burnout of soot even in unsteady combustion processes with a minimum of secondary gas.

In an embodiment, the present invention provides a method for characterizing a flue gas burnout quality of a combustion process in a combustion system having a gas burnout zone includes optically detecting in a visible wavelength range, in a flow cross section of the gas burnout zone, low-soot combustion regions, regions without combustion, and sooting regions, so as to provide a plurality of successive individual images, the regions without combustion and the sooting regions having different dynamics. The plurality of successive individual images are analyzed so as to distinguish regions of transition, to the low-soot combustion regions, of the regions without combustion and the sooting regions.

BRIEF DESCRIPTION OF THE DRAWINGS

The present invention is described in greater detail below on the basis of embodiments and of the figures cited below. The following is shown.

DETAILED DESCRIPTION

Figure 1:
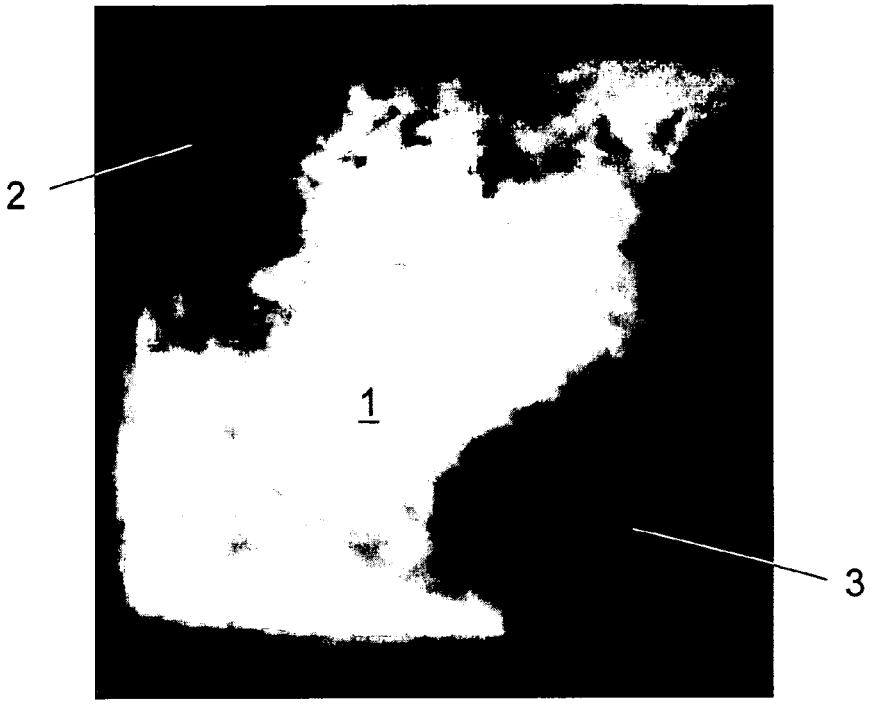
FIG. 1 shows an individual image taken of a cross section of a gas burnout zone using a CMOS camera.

In an embodiment, the present invention provides a method for characterizing the flue gas burnout quality of a combustion process in combustion systems having a gas burnout zone, said method enabling selective determination of streaks of soot; i.e., solid particles, in the flue gas.

The method includes the idea that in a flow cross section of the gas burnout zone, low-soot combustion regions (preferably without soot formation), regions without combustion, and regions of soot formation are optically detectable in the visible wavelength range. Low-soot combustion regions always appear bright (high radiation intensity), while regions without combustion (cold grate regions) and sooting regions always appear dark (low radiation intensity). The combustion regions become increasingly dark as the soot content increases; i.e., the radiation intensity decreases continuously as a function of the soot content. Moreover, the regions without combustion and the sooting regions are characterized by different dynamics in their behavior over time, which are detectable by analysis, preferably by averaging or comparison of a plurality of successive individual images.

A camera system measuring in the visible wavelength range (about 400 to 1000 nm) can be used. Said camera system includes a camera, such as a video camera, and can be adapted to a gas burnout zone in such a way that it monitors preferably an entire flow cross section therein. Unlike detection systems for the infrared range or other invisible wavelength ranges, camera systems of the aforementioned type are commercially available in high quality and with high resolution at comparatively low prices in the form of fully developed standard systems for various applications.

The camera system can be used to record the combustion process in the flow cross section in the form of a sequence of individual images. These individual images are "snapshots" of the flue gas burnout process in the entire flow cross section. The camera settings and the image area are not changed between different individual images. The image area can, for example, correspond to the flow cross section in the region of the flue gas burnout zone. For image analysis (image processing), this flow cross section can be divided into segments containing a number of picture elements (pixels). The analysis essentially includes classification of the segments into one of the regions mentioned above, or into transition regions between two regions, using the steps described below.

At least two of the successive individual images can be averaged (preferably on a pixel-by-pixel basis) to generate an averaged image therefrom. In this averaged image, low-soot combustion regions can be identified in that their intensity values (radiation intensity) are above a settable intensity threshold. The intensity threshold can be manually or automatically determined relative to the maximum intensity in the recorded image (for example, 50, 60 or 70 percent relative to the particular maximum value), or can be manually set as an absolute value. A manually set intensity threshold can be derived based on experience, and preferably remains unchanged between successive measurements for the sake of improved comparability of these measurements, for example, to allow for system monitoring.

Subsequently, the transition regions are located as the pixels which were assigned to the low-soot combustion region, but have at least one neighboring pixel that does not belong to the low-soot combustion region. After that, these transition regions can be assigned to the transition segments. Each segment can be analyzed as to whether it is to be classified as belonging to one of the aforementioned regions, or, as a transition segment, to at least two of the aforementioned regions; i.e., to a transition region. A region can be a transition region if the intensity detected therein is equal to the intensity threshold, or if there is a transition from a value below the threshold to a value above the threshold. In an individual image, or in an averaged image, the mostly linear transition regions can be represented as lines which can be highlighted, for example, in color (e.g., false color representation). A segment in which the intensity threshold is crossed both from below and from above can always be considered to be a transition segment. The assignment of segments to transition segments can usually be done based on settable thresholds for the area percentages of the various regions mentioned above.

Subsequently, the transition segments can be assigned to the regions involved. A transition can be characterized by a change in brightness. This change in brightness can be determined, for example, using a brightness gradient or, on a segment-by-segment basis, by determining a contrast which can be calculated using a co-occurrence matrix (see the web site weblearn.bs-bremen.de/risse/AWI/TEXTUR/merkmale-.htm, as of Sep. 13, 2006).

Transitions from a low-soot combustion region to a region without combustion can be characterized by less motion dynamics than soot transitions; i.e., transitions from low-soot combustion regions to sooting regions. In averaged images generated from a plurality of individual images, soot transitions can be characterized by a lower level of definition or by lower contrast; i.e., they appear much more blurred than transitions from a low-soot combustion region to a region without combustion (grate transitions), although this is not necessarily so in individual images.

The assignment of the transition segments to the fraction of soot transitions or to the fraction of grate transitions can, for example, be done by determining the contrast for each transition segment separately and comparing the contrast values to a contrast threshold. If the contrast value of a segment is below the contrast threshold, the particular transition segment can be a soot transition segment, if it is above the threshold, the particular transition segment can be a grate transition.

The contrast values refer, for example, to the light intensity (bright/dark contrast). Other contrasts, such as color contrasts, may in principle also be used for the aforementioned classification, for example, in conjunction with color manipulation, but may require more computational effort. Therefore, if the task is to characterize the flue gas burnout quality substantially in real time, other contrasts are preferable only in special cases.

In an alternative method of analysis, soot transitions and grate transitions could also be distinguished by comparing individual transition segments or a different group of pixels of the transition segments from successive individual images. Relatively great and fast changes in the intensity values of a segment or of a group of pixels from a plurality of successive individual images suggest increased dynamics in the transition region, and can therefore be a sign of soot transitions.

If the analysis of contiguous transition segments of a linear transition region shows that these segments are not uniform, but partly to the fraction of soot transitions and partly to the fraction of grate transitions, then the individual fractions may optionally be weighted. This process may include the step of detecting contiguous transition segments of one fraction, and of individual transition segments of a fraction that are surrounded by the respective fraction. If there is a clear predominance of transition segments of one of the fractions, all transition segments may be assigned to this fraction. It is also possible for individual segments of a fraction to be assigned to the fraction of the neighboring segments by means of neighborhood analysis. However, contiguous transition segments of a fraction are only assigned to the other fraction if, as possible measurement errors, they represent a single event (plausibility check).

Upon completion of the aforementioned classification of the transition segments, all segments in which more than half of the pixels have an intensity below the threshold can be iteratively assigned to the sooting region or to the region without combustion by analyzing neighborhood relationships with transition segments and segments that have already been classified. The classification of these segments can be done separately for each segment in iterative steps by applying to each of said segments the same class membership as that of its previously identified neighboring segments or transition segments (neighborhood analysis). If the previously classified neighboring segments do not all have the same class membership, the segment can be assigned to the region to which most of the neighboring segments have already been assigned. Each of the iteration steps can preferably be performed on segments which are adjacent to a largest possible number of previously classified transition segments or previously classified segments of preferably the same fraction.

The final step in the characterization of the flue gas quality includes determining the respective locations, areal extents, and intensity distributions of all identified regions. From these parameters, it is possible to compute control signals for measures aimed at improving the flue gas burnout quality, such as controlled introduction of oxygen-containing gases (for example, secondary gas in the case of sooting regions) or additional fuels (in the case of regions without combustion), it being preferred for said introduction to be done differently for different locations and in a manner adapted to the local combustion conditions (preferably on a segment by segment basis or by groups of segments).

If the method is used to generate control signals for a measure aimed at continuously improving the burnout of soot (e.g., controlled injection of oxygen-containing gas), the determination of parameters based on individual images should be performed in real time as the method is carried out. Also, when a plurality of nozzles is used, an afterburning process can be influenced in each segment individually by adding an oxygen-containing gas.

During the following exemplary experiment, the flue gas burnout of a grate-fired incineration plant was characterized. The camera images shown in FIGS. 1 through 4 were taken from above, looking against the direction of gas flow, the image area covering the radiation pass cross section in the flue gas burnout zone between the combustion grate and a downstream afterburner chamber having a secondary gas injection feature. The camera used is a camera measuring in the visible wavelength range, for example, a CMOS camera.

FIG. 1 shows an individual image of the flue gas burnout, showing a bright low-soot combustion region 1 and two dark regions of low radiation intensity, namely a grate region 2 (region without combustion) and a heavily sooting combustion region 3 (sooting region). In this individual image, the transition regions between the aforesaid regions exhibit similar brightness gradients, which makes it impossible for the respective neighboring dark regions to be unequivocally assigned to the region without combustion or to the sooting region.

It is an object of the present invention to automatically identify said regions of low radiation intensity based on a plurality of individual images, and to classify whether they are regions of high soot content (sooting region) or cold grate regions. This should preferably be done in real time in order to be able to take appropriate measures, such as injection of additional gas.

Figure 2:
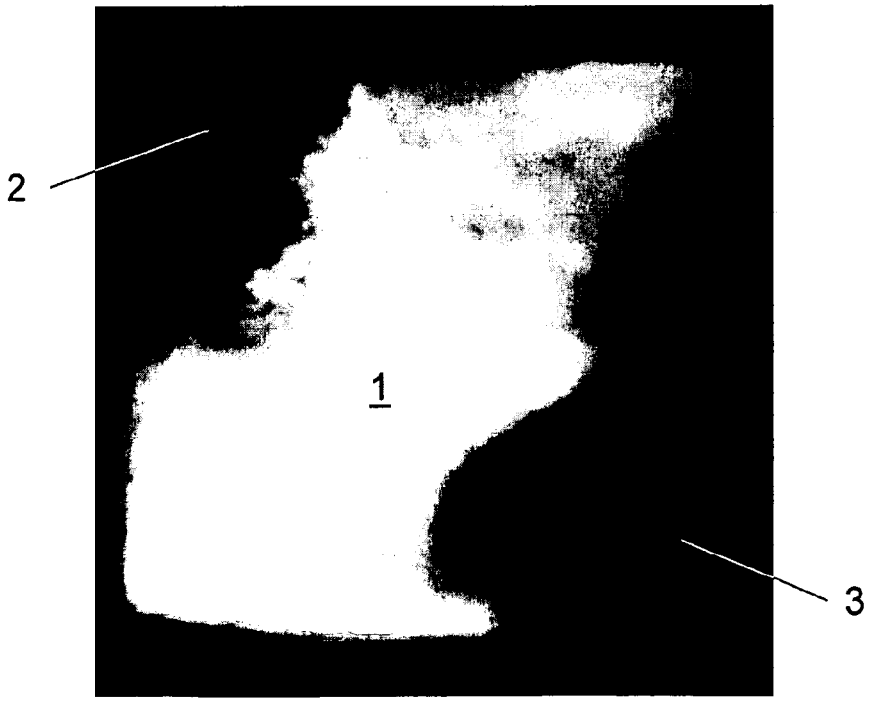
FIG. 2 shows an averaged image generated from 20 successive individual images as that in FIG. 1, taken within one second.
Figure 3:
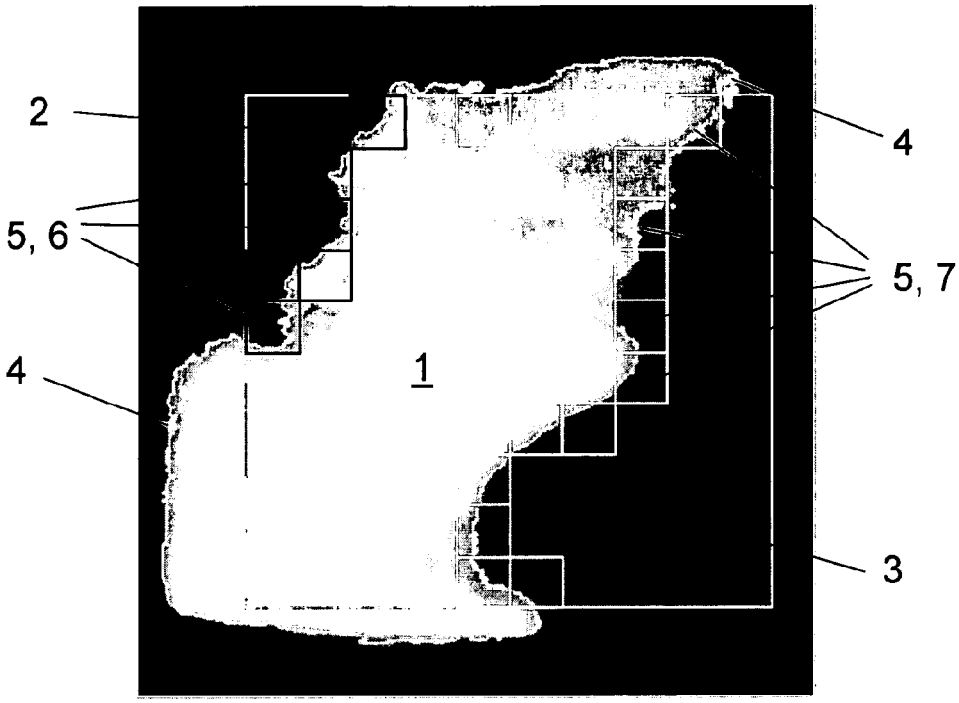
FIG. 3 shows an image of the same area as in FIG. 2, but illustrating the transition segments between the low-soot combustion region and the sooting region (bright border) and between the low-soot combustion region and the region without combustion (dark border)

FIG. 2 shows an averaged image generated from 20 successive individual images as that in FIG. 1, taken within one second. Unlike an individual image (see FIG. 1), the boundaries between combustion 1 (flame) and sooting region 3 are very fuzzy in this averaged image, which is due to the high motion dynamics of the soot particles in the flow field region. Because the dynamics of the boundary between the cold grate region and the low-soot combustion region is low compared to that of the soot, this boundary is still relatively sharply defined in the averaged image.

This difference in the nature of the transition regions between the combustion and the sooting region or the region without combustion is used at a later stage of the method to distinguish between sooting regions 3 and regions without combustion (cold grate regions 2). To this end, first a boundary between the low-soot combustion region of high radiation intensity and the region without combustion or the sooting regions is determined based on a relative radiation intensity threshold, and is added to the averaged image as a transition line 4 (transition region; see the gray line in FIG. 3). The averaged image is divided into segments. The segments covering the transition line 4 between high-emission and low-emission regions are determined as transition segments 5.

Then, contrast analysis is performed on the aforesaid transition segments 5 to establish whether a particular segment is a grate transition segment 6 (the segments surrounded by a black border in FIG. 3); i.e., a segment containing a boundary between a region without combustion (grate region) and a low-soot combustion region, or whether it is a soot transition segment 7 (the segments surrounded by a white border in FIG. 3), i.e., a segment containing a boundary between a sooting region and a low-soot region.

In addition, the integral intensity of each of the transition segments is checked, for example, against the intensity threshold at a later point in time, and the transition segments above the threshold are assigned to the low-soot combustion regions. Alternatively, each transition segment in which at least half of the pixels have an intensity above the threshold may be assigned to the low-soot combustion region.

Figure 4:
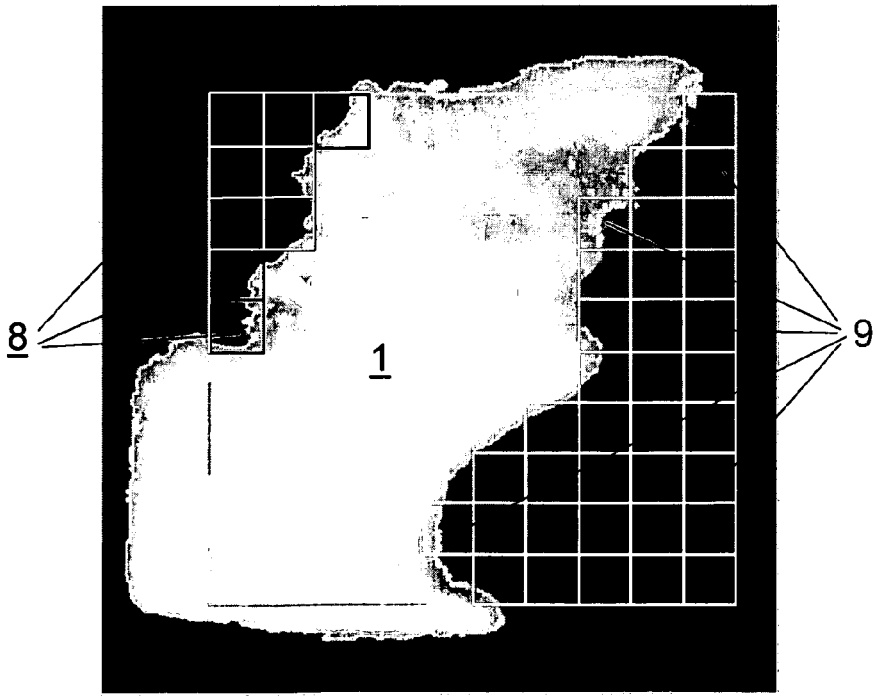
FIG. 4 shows the image area shown in FIGS. 2 and 3 after the dark segments have been iteratively assigned to cold grate regions (region without combustion, dark border) and sooting regions (bright border) based on neighborhood relationships.

Subsequently, all other segments which are outside the transition segments and cover the regions of low radiation intensity are iteratively analyzed as to whether they belong to a cold grate region or to a heavily sooting region (see FIG. 4). This is done by analyzing the respective neighborhood relationships with the transition segments. In this manner, the dark image regions in the averaged image are divided into grate segments 8 (including the grate transition segments 6) and soot segments 9 (including the soot transition segments 7). In the present example, the regions were unequivocally identified. There was no need to perform a plausibility check.

Household waste and biomass of varying moisture contents are in general very inhomogeneous fuels and therefore have widely varying heating values. Such fuels promote low-combustion, cold grate regions (regions without combustion) as well as incomplete combustion (sooting regions). These fuel properties result in variations in the ignition and combustion behavior. In industrial combustion systems (e.g., grate-fired, fluidized bed, or rotary kiln combustion systems), this fuel characteristic leads to local inhomogeneities during burnout of the solid matter and in the flue gas composition (flue gas streaks) within the combustion chamber and in the region of the flue gas burnout zone. In addition, the location and intensity of these flue gas streaks exhibit pronounced temporal and spatial fluctuations, with the sooting regions always exhibiting significantly higher dynamics.

Figure 5:
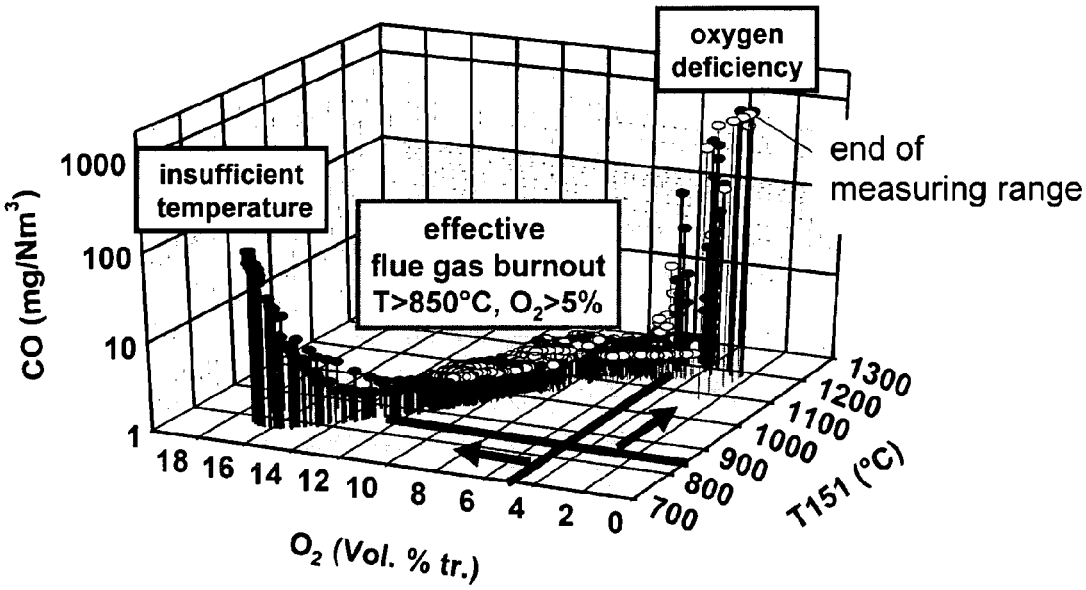
FIG. 5 is a characteristic diagram showing regions of efficient flue gas burnout and using the example of carbon monoxide, CO, plotted as a function of the combustion temperature and oxygen content. The soot concentration characteristic is similar to that of CO.

In accordance with the present invention, these inhomogeneities in the flue gas or combustion gas are detected in the region of the combustion chamber/flue gas burnout zone, preferably in real time, using measuring means, such as optical means, and are compensated for by controlled injection of an oxygen-containing gas in a spatially selective manner and/or by effective mixing, such that the incompletely burned flue gas components can be virtually completely burned in short time at high temperatures in the presence of a sufficient supply of oxygen (above 5 percent by volume of dry oxygen in the raw gas, T>850° C., see FIG. 5).

Similar to the soot concentration, the concentration of carbon monoxide (CO) in the combustion gas, which is shown in FIG. 5, is an indicator of the burnout. The soot burnout has a similar characteristic. Good burnout is characterized by low concentrations of CO, $C_nH_n$, and soot, which essentially depend on the local supply of oxygen and on the temperature in the region of the flue gas burnout zone. The measured values shown in FIG. 5 show significant increases in carbon monoxide and hydrocarbon at temperatures below 800° C. (measured values shown to the left in FIG. 5) and for oxygen concentrations of less than 5 percent by volume (measured values shown to the right in FIG. 5), while the measured values shown in the middle are indicative of a satisfactory burnout (ideally: T>850° C. and $O_2$>5 percent by weight). The last-mentioned values comply, for example, with the $17^{th}$ Ordinance implementing the Federal Immission Control Act, which requires waste incineration to be carried out at a temperature of at least 850° C. for a residence time of more than 2 seconds after the last injection of oxygen-containing air. These conditions must be maintained at all times and at all locations over the entire cross section of the flue gas burnout zone.

In waste incineration, it is very important to minimize the concentration of soot particles by means of efficient burnout. Soot particles and chloride-containing fly ashes are deposited together on the surface of the boiler or are removed during dedusting. In the temperature range below 200° C., these soot particles may undergo oxychlorination reactions, forming polychlorinated dibenzo-p-dioxins and furans (PCDD/F) in a process known as de-novo synthesis. In this process, particulate carbon (soot particles) is the predominant source of carbon. Even if failures are of short duration, PCDD/F are formed during a very long period of time. The maximum formation of PCDD/F is dependent on the soot deposition rate. Even when the combustion process proceeds in a controlled manner again, the formation of PCDD/F continues as long as there are carbon particles in the boiler deposits (memory effect).

The aforementioned real-time measurements of local soot concentrations allow such failures to be detected and reduced or avoided by prompt controlled injection of air and intensive mixing in the region of the flue gas burnout zone.

More generally, the present invention allows fine dust emissions (soot particles) from combustion, in particular of inhomogeneous fuels, to be detected and efficiently reduced by means of control signals derived therefrom.

The present invention is not limited to the embodiments described herein; reference should be had to the appended claims.

LIST OF REFERENCE NUMERALS

1 low-soot combustion region
2 grate region
3 sooting region
4 transition line
5 transition segment
6 grate transition segment
7 soot transition segment
8 grate segment
9 soot segment

What is claimed is:

1. A computer implemented method for characterizing a flue gas burnout quality of a combustion process in a combustion system having a gas burnout zone, the method comprising:

optically detecting in a visible wavelength range, in a flow cross section of the gas burnout zone, low-soot combustion regions, regions without combustion, and sooting regions, so as to provide a plurality of successive individual images, the low-soot combustion regions appearing bright and the regions without combustion and the sooting regions both appearing dark; and analyzing the plurality of successive individual images so as to identify different motion dynamics of the regions without combustion and the sooting regions in an averaged image of at least two of the plurality of successive individual images and distinguish regions of transition, from the low-soot combustion regions, to both the regions without combustion and the sooting regions, wherein the different motion dynamics are identified by determining levels of contrast of the regions of transition of the averaged image so as to distinguish the regions of transition from the low-soot combustion regions to the sooting regions which have a lower level of contrast in the averaged image than the regions of transition from the low-soot combustion regions to the regions without combustion.

2. The method for characterizing a flue gas burnout quality recited in claim 1, wherein the optically detecting is performed using an imaging device.

3. The method as recited in claim 1, wherein:

the optically detecting is performed using a camera;

the optically detecting includes:

monitoring the flow cross section of the gas burnout zone in a direction against a flow therein; and recording the combustion process in the flow cross section with at least two successive individual images taken by the camera; and the analyzing includes:

dividing the flow cross section into segments containing a plurality of respective pixels;

locating, in the flow cross section, the low-soot combustion regions in which an intensity value is above an automatic or manually settable intensity threshold, the intensity threshold being set relative to a maximum intensity in the flow cross section;

locating the regions of transition as pixels assigned to the low-soot combustion regions and having at least one neighboring pixel that does not belong to the respective low-soot combustion region;

assigning the segments of the regions of transition as transition segments;

determining a contrast value for each of the transition segments;

assigning the transition segments having contrast values above a contrast threshold to a transition between a respective low-soot combustion region and a respective region without combustion, and the assigning transition segments having contrast values below the contrast threshold to a transition between a respective low-soot combustion region and a respective sooting region;

iteratively assigning all segments in which more than half of the pixels have an intensity below the intensity threshold to a respective sooting region or to a respective region without combustion by analyzing neighborhood relationships with transition segments and segments that have already been assigned; and identifying and locating the sooting regions based on percentages and positions of the segments that have been assigned to the respective sooting region.

4. The method as recited in claim 3, further comprising transforming the identification and location of the sooting regions into control signals for injection of au oxygen-containing gas into the gas burnout zone.

5. The method as recited in claim 4, wherein the injection is performed differently for different locations in a manner adapted to local combustion conditions.

* * * * *